United States Patent [19]

Costello et al.

[11] Patent Number: 4,715,300

[45] Date of Patent: Dec. 29, 1987

[54] METHOD OF DISPOSING OF MATERIALS BY DISSOLVING IN ACID AND THEN INCINERATING

[75] Inventors: Rocky C. Costello; Robert L. Dixon, both of Houston, Tex.

[73] Assignee: Stauffer Chemical Company, Westport, Conn.

[21] Appl. No.: 43,052

[22] Filed: Apr. 27, 1987

[51] Int. Cl.[4] ..... F23G 7/00

[52] U.S. Cl. ..... 110/346; 110/341; 110/342

[58] Field of Search ..... 110/238, 341, 342, 346, 110/243

[56] References Cited

U.S. PATENT DOCUMENTS 4,284,015 8/1981 Dickinson ..... 110/342

*Primary Examiner*—Carroll B. Dority, Jr.

*Attorney, Agent, or Firm*—Richard P. Fennelly

[57] ABSTRACT

A method of disposing of acid-dissolvable materials (e.g., rags) which, optionally, are impregnated with a waste material (e.g., solvents, oils, paints, and the like) is described. The first step of the procedure involves the dissolving of the acid-dissolvable materials in a strong mineral acid to form an acid solution comprising the dissolved material, and, optionally, waste which has been impregnated thereon. This acid solution is then fed to the incinerator for incineration, preferably to the incinerator of an acid regeneration plant.

8 Claims, No Drawings

METHOD OF DISPOSING OF MATERIALS BY DISSOLVING IN ACID AND THEN INCINERATING

BACKGROUND OF THE PRESENT INVENTION

1. Field of the Present Invention

The present invention relates to a method of disposing of materials by at least partially dissolving them in acid and then incinerating the resulting acid composition containing them. 2. Description of the Prior Art It is desirable to develop methods which result in the efficient and economical disposal of waste materials, particularly those materials having some degree of bulk, e.g., shaped articles, fabrics, and the like. For example, when certain substrates, e.g. fibrous substrates, such as rags and paper products, are impregnated with waste materials, e.g., solvents, oils, hazardous chemicals, and the like, it is desirable to provide a means for their economical and environmentally sound disposal. Placing such bulky materials in a landfill poses certain environmental problems which render such an approach generally undesirable. Although such materials can be directly incinerated, such an approach also has certain disadvantages. For one thing, the handling of the bulky material preparatory to incineration is labor intensive. Secondly, special precautions need to be taken in regard to the design of the incineration apparatus in order to perform the incineration in the most environmentally sound fashion.

Hence, a need exists for a more efficient, economical, and environmentally sound way of disposing of the aforementioned type of bulky material.

SUMMARY OF THE PRESENT INVENTION

The present invention is a method of disposing of such bulky materials which comprises at least partially dissolving the materials in a strong mineral acid to form an acid solution comprising the at least partially dissolved material, followed by feeding the acid solution from the dissolving step to an incinerator. Preferably, the incinerator which is employed is the incinerator of an acid regeneration plant since such an incinerator is designed to receive, for incineration, spent acid solutions which bear a reasonable degree of general compositional identity to the acid solution resulting from the dissolution step of the present invention. Incinerators in acid regeneration plants also include the preferred type of anti-pollution equipment (e.g., scrubbers and the like) which are generally mandatory pursuant to laws intended to protect the environment. For example, if sulfuric acid is the digesting acid the incineration step will yield sulfur dioxide which should not be discharged into the atmosphere in any appreciable amount. However, it is to be understood that other types of incinerators can be used, if desired. Examples include lime kilns and cement kilns. Such kilns are intended to be included under the generic term "incinerator" for purposes of the present invention.

DETAILED DESCRIPTION OF THE PRESENT INVENTION

The present invention is applicable to any waste material which needs disposal and which is dissolvable in an acid to be regenerated in the incinerator, e.g., of an acid regeneration plant. Examples include cellulose-based materials, e.g., rags which can be impregnated with undesired wastes (oils, solvents, paints, hazardous chemicals, and the like). The present invention relies upon the acid dissolvable characteristics of the material intended to be dissolved so that a resulting, more liquid product is produced which is capable of being fed to the incineration of an acid regeneration plant, for example. The following description of the present invention will be undertaken in terms of the treatment of acid dissolvable substrates impregnated with waste materials. However, it is to be understood that this only forms a preferred embodiment of the present invention which is more generally applicable to the treatment of acid dissolvable materials followed by incineration of the resulting composition, preferably in the incinerator of an acid regeneration plant.

The types of waste-impregnated materials which can be treated by the present method comprise, in a preferred embodiment, an acid-dissolvable substrate which has been impregnated with the waste material. Representative acid-dissolvable materials include such fibrous materials as rags, fabrics, paper products, and the like which hitherto have been difficult to dispose in an economical and environmentally acceptable manner. The fibrous material can be formed, for example, from a carbohydrate material such as cellulose, nitrocellulose or ethylcellulose. In a preferred embodiment, the substrate comprises a fabric consisting primarily of cotton or of cotton blended with a synthetic fiber, such as polyester. However, the present invention is not limited to these type of substrate materials and is broadly applicable, as described before, to acid-dissolvable materials, in general.

The type of waste which impregnates the substrate, in a preferred embodiment, is also capable of wide variation. For instance, solvent bearing rags from various industries such as the automotive, aerospace and painting industries are intended to be included for processing within the scope of the present invention. The rags can be impregnated with such waste materials as oils, paints, solvents, or chemicals. It is not necessary that the waste be reactive with the acid in which the acid-dissolvable substrate material containing the waste is to be dissolved. However, it is included within the scope of the present invention to have the waste be reactable with the acid, if desired.

The materials to be treated in accordance with the present invention can be charged "as is" or can be shredded prior to addition to the strong mineral acid in which they are to be dissolved. A preferred mineral acid for use in dissolving the substrate material in accordance with the practice of the present invention is sulfuric acid. Preferably, sulfuric acid predominates as the acidic material in the acid dissolving media that is used. It is, however, within the scope of the present invention to allow for the presence of minor amounts of other (e.g., acidic) materials as long as their presence does not adversely affect the incineration step which folows, e.g., incineration in the incinerator of an acid regeneration plant.

The dissolving of the substrate material, e.g., with its impregnated waste, is preferably carried out in a stirred tank reactor to which a concentrated mineral acid is added to order to achieve the necessary degree of dissolving of the substrate material and concomitant dissolution of the impregnated waste in the acid. Spent acid can be used in this dissolving step. The mixture of waste-impregnated substrate material and acid can be desirably agitated until the substrate dissolves to a sufficient degree to yield a sufficiently liquid acidic composition to be fed (e.g., via suitable pumps) to the incinerator of an acid regeneration plant, for example (e.g., preferably, a sulfuric acid regeneration plant). It has been found, for example, that approximately five parts or more of concentrated (98%) sulfuric acid are needed for every one part of cotton rags in order to make an appropriate liquid mixture. For cotton/polyester blends, it has been found that approximately 3 parts or more by weight of concentrated (98%) sulfuric acid are needed for every one part by weight of rag. The strength and type of acid solution used in the dissolving step and the type and amount of material to be dissolved will largely dictate the amount of acid solution needed to achieve the desired degree of liquid consistency for the feed to the desired type of incinerator. The mixture of acid-dissolvable substrate and acid may require cooling in the form of an internal cooling coil or an external circulating heat exchanger, depending on the rate of digestion desired and the materials of construction.

The step of dissolving the material, e.g., containing the waste impregnated, in the acid yields a generally liquid, acid solution comprising, for example, the dissolved material and, optionally, any waste impregnated thereon which is suitable for feeding, for example, to the incinerator in a conventional acid regeneration plant for the acid for combustion. In the case of a sulfuric acid regeneration plant, incineration temperatures of from about 1700° F. to about 2300° F. would generally be used in the incineration step of the present process. These temperatures insure the substantially complete combustion of the waste material along with concomitant recovery of the mineral values in the acid feed to the incinerator. The process enables one to convert the substrate and impregnated waste from solid to liquid form so as to be suitable for easier feeding to the incineration apparatus of an acid regeneration plant.

It is to be understood that for purposes of the present invention the acid dissolving step and the incineration steps can be either practiced at the same general location or at two geographically distinct locations with the product from the dissolution step being transported to the incinerator, for example, by means conventionally used to transport spent acid solutions.

The present process has certain advantages. The energy value associated with the substrate, e.g. cellulose rags, as well as of the waste material that is contained therein is recovered in the incineration step. The present process also results in the formation of a liquid waste feed from the acid dissolving step which is more easily handled as a pumpable liquid rather than as a solid waste. Solid waste handling is highly labor intensive and is not preferred for that reason. Also, the acid dissolving step can employ any type of strong mineral acid to dissolve the substrate, including spent mineral acid, such as spent sulfuric acid. In those cases in which spent acid, rather than pure acid, is employed in the dissolving step, the process allows for at least two wastes (i.e. the materials (optionally impregnated with a third waste) and the spent acid) to ultimately create a single, more liquid feed stream that can be conveniently fed, for example, to the acid regeneration plant for incineration in accordance with conventional techniques for doing so.

The foregoing is intended to illustrate certain preferred embodiments of the present invention and should not be construed in a limiting sense. The scope of protection that is sought is set forth in the claims which follow.

We claim:

1. A method of disposing of acid-dissolvable solid materials which comprises:

(a) dissolving the acid-dissolvable materials in a strong mineral acid to form an acid solution comprising the dissolved material; and (b) feeding the acid solution from (a) to an incinerator for incineration.

2. A method as claimed in claim 1 wherein the material comprises a cellulose-based fabric.

3. A method as claimed in claim 1 wherein the acid comprises sulfuric acid.

4. A method as claimed in claim 2 wherein the fabric is impregnated with a waste material.

5. A method as claimed in claim 4 wherein the acid comprises sulfuric acid.

6. A method as claimed in claim 1 wherein the incinerator has incineration temperatures of from about 1700° F. to about 2300° F.

7. A method as claimed in claim 3 wherein the incinerator has incineration temperatures of from about 1700° F. to about 2300° F.

8. A method as claimed in claim 5 wherein the incinerator has incineration temperatures of from about 1700° F. to about 2300° F.

* * * * *